US005464205A

United States Patent [19]

Bang

[11] Patent Number: 5,464,205

[45] Date of Patent: Nov. 7, 1995

[54] FACSIMILE

[75] Inventor: Doo-jin Bang, Seoul, Rep. of Korea

[73] Assignee: SamSung Electronics Co., Ltd., Suwon, Rep. of Korea

[21] Appl. No.: 84,158

[22] Filed: Jul. 1, 1993

[30] Foreign Application Priority Data

Nov. 11, 1992 [KR] Rep. of Korea ..... 92-21112

[51] Int. Cl.[6] ..... B65H 31/04

[52] U.S. Cl. ..... 271/213; 271/145; 271/162; 271/207

[58] Field of Search ..... 271/145, 162, 271/207, 213

[56] References Cited

U.S. PATENT DOCUMENTS

| | | | |
|---|---|---|---|
| 3,799,538 | 5/1974 | Suzuki | 271/162 |
| 3,912,389 | 10/1975 | Miyamoto | 271/213 |
| 4,744,472 | 5/1988 | Pfister | 211/50 |
| 4,825,395 | 4/1989 | Kinser, Jr. et al. | 364/708 |
| 4,854,010 | 8/1989 | Maraghe et al. | 16/360 |
| 5,085,422 | 2/1992 | Sagara | 271/145 X |
| 5,120,045 | 6/1992 | Kamezaki et al. | 271/162 |
| 5,137,174 | 8/1992 | Bell | 271/161 |
| 5,234,212 | 8/1993 | Datra, Jr. | 271/213 X |

FOREIGN PATENT DOCUMENTS

| | | | |
|---|---|---|---|
| 56-81856 | 4/1981 | Japan . | |
| 0070625 | 3/1990 | Japan | 271/162 |
| 404049162 | 2/1992 | Japan . | |
| 4045057 | 2/1992 | Japan | 271/213 |

*Primary Examiner*—H. Grant Skaggs
*Assistant Examiner*—Carol L. Druzbick
*Attorney, Agent, or Firm*—Robert E. Bushnell

[57] ABSTRACT

An image forming device such as a facsimile telecommunications unit having an improved structure of a self-stacking discharge paper tray includes a housing for the unit, a cover hinged at the sides of the facsimile unit's housing to be capable of being opened and closed, and a paper tray hinged onto the cover so that the rotational path of the cover differs from that of the paper tray, thereby enabling the complete opening of the cover without first removing the paper tray. When the facsimile unit is transported, handling is facilitated and shipping volume is reduced.

26 Claims, 5 Drawing Sheets

FACSIMILE

BACKGROUND OF THE INVENTION

1. Technical Field

The present invention relates to an image forming device, and more particularly, to an image forming device having an improved structure for a paper tray supporting sheets of paper bearing messages received, formed or printed by the unit.

2. Background Art

In many designs of conventional image forming devices such as facsimile telecommunication units, photocopiers and printers, a cover is installed at the upper portion of an image forming device's housing so as to be capable of being opened and closed. A paper tray supporting stacks of sheets of paper bearing printed or facsimile messages formed, or received, by the unit, is connected to the rear surface of an image forming device's housing. The tray is typically attached by a connection fixedly inserted into a slot formed in the device's housing.

In this type of image forming device, the tray is attached so that when the user attempts to open the cover, movement of the cover is obstructed by the tray. Also, with such structures repeated opening and closing of the cover often results in damage to either the slot in the housing or the connection of the tray. Therefore, the tray should be separated from the image forming device's housing before the cover is opened, an awkward requirement.

A recent effort to provide a discharge paper tray, described in Japanese Laid Open patent application Ser. No. 4-49162 of Hidetoshi Nagata, provides an external vertical wall member pivoted about one axis and a paper discharge tray pivoted about a second and different axis. In this design the location of the second axis however, requires a pair of mounts that inconveniently protrude beyond the vertical wall of the device. Moreover, when the vertical wall member is opened, the over-simplicity of the design causes the tray to shift from an orientation toward the discharge exit to an orientation downwardly away from the discharge exit, thereby inconveniently spilling any sheets of paper previously stacked within the tray.

A pair of earlier designs, shown in Japanese Laid-Open patent application Ser. No. 56-81856, sought to address the problem of spilling the stack when the vertical wall member was opened to clear a jammed sheet of paper from the output rollers, but at the expense of either adding a linkage extending between the proximal end of the tray and the interior of the device, or adding a bumper which protrudes beyond the vertical bulkhead of the device to intercept the downwardly shift in orientation of the distal end of the tray as the vertical wall member is opened. Both designs undesirable add components to the structure of the device, thereby compromising its simplicity, while the latter design requires a member that undesirably extends horizontally outwardly from the base of the device, thereby enlarging the footprint of the device.

Additionally, with conventional designs, when the image forming device is shipped or simply relocated from one site to another within the same office, the tray should be removed from the image forming device's housing and be packed either together with the housing or be transported separately. Therefore, handling of the an image forming device can be troublesome due to excessive volume require to ship both the device and its tray.

SUMMARY OF THE INVENTION

It is one object of the present invention to provide an improved image forming device.

It is another object to provide an image forming device with a paper tray for supporting sheets of paper bearing received facsimile messages.

It is still another object to provide an image forming device supporting a paper tray that is rotatably installed in tandem with the cover.

It is yet another object to provide an image forming device having a paper tray mounted so as to enable the opening and closing of the cover without separating the tray from the facsimile housing.

It is still yet another object to provide an image forming device having a paper tray mounted to reduce shipping volume.

It is a further object to provide an image forming device supporting an external, outwardly projecting paper tray accommodating opening of the cover of the unit.

It is a yet further object to provide an image forming device supporting an external, outwardly projecting paper tray that is positionable, without detachment from the unit, into a configuration lying in juxtaposition with an exterior surface of the unit when the unit is being moved, shipped or packaged.

It is a still further object to provide a simplified configuration for an image forming device supporting a tray mounted to rotate about a single pivot between an outwardly extended cantilevered position where the tray serves as a self-stacking paper tray and to rotate to a second position lying substantially flush against a side of the device.

It is an additional object to provide a compact image forming device supporting, in a simplified configuration, a tray mounted to rotate about a single pivot between an outwardly extended cantilevered position where the tray serves as a self-stacking paper tray while accommodating opening of the cover of the device without spilling sheets of paper stacked within the tray, and to rotate to a second position lying substantially flush against a side of the device.

To accomplish these and other objects, an image forming device may be constructed according to the principles of the present invention with a housing, a cover hinged at the sides of the image forming device's housing so as to be capable of being opened and closed, and a paper tray for supporting sheets of paper bearing messages printed by the unit. The tray is hinged on the cover so that the rotational path of the cover differs from that of the tray.

Additionally, in an image forming device constructed according to the principles of the present invention, the tray is installed so as to fold when not in use, with the surface of the tray lying upon the top surface of the cover.

BRIEF DESCRIPTION OF THE DRAWINGS

A more complete appreciation of this invention, and many of the attendant advantages thereof, will be readily apparent as the same becomes better understood by reference to the-following detailed description when considered in conjunction with the accompanying drawings in which like reference symbols indicate the same or similar components, wherein.

DETAILED DESCRIPTION OF THE PREFERRED EMBODIMENT

Figure 1:
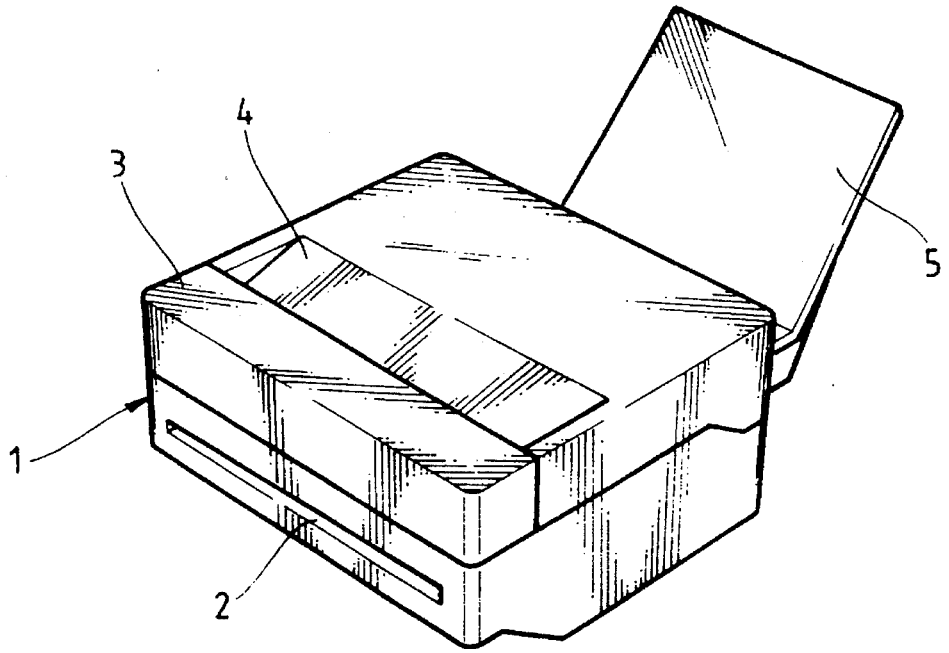
FIG. 1(PRIOR ART)
FIG. 1 is a perspective view of a conventional facsimile telecommunications unit.

Turning now to the drawings, a conventional facsimile telecommunications unit is illustrated in FIG. 1 as an example of a typical design of a contemporary image forming device, with a cover 3 installed at the upper portion of a facsimile unit's housing 1 so as to enable cover 3 to be opened and closed as desired by an operator using the unit. A paper-feed inlet 4 where sheets of documents to be transmitted by the facsimile unit are inserted is formed on the upper surface of cover 3. A paper-feed outlet 2 is formed on the front surface of facsimile unit's housing 1, to enable sheets of paper to exit from the facsimile unit after transmission has been completed. Also, a paper tray 5 is connected to the rear surface of housing 1 for receiving and maintaining in a stack sheets of paper bearing facsimile messages received by the facsimile unit. Paper tray 5 is, as illustrated in FIG. 2, attached with a connection 7 inserted into a slot 6 formed in a vertical interior wall of facsimile housing 1.

Figure 2:
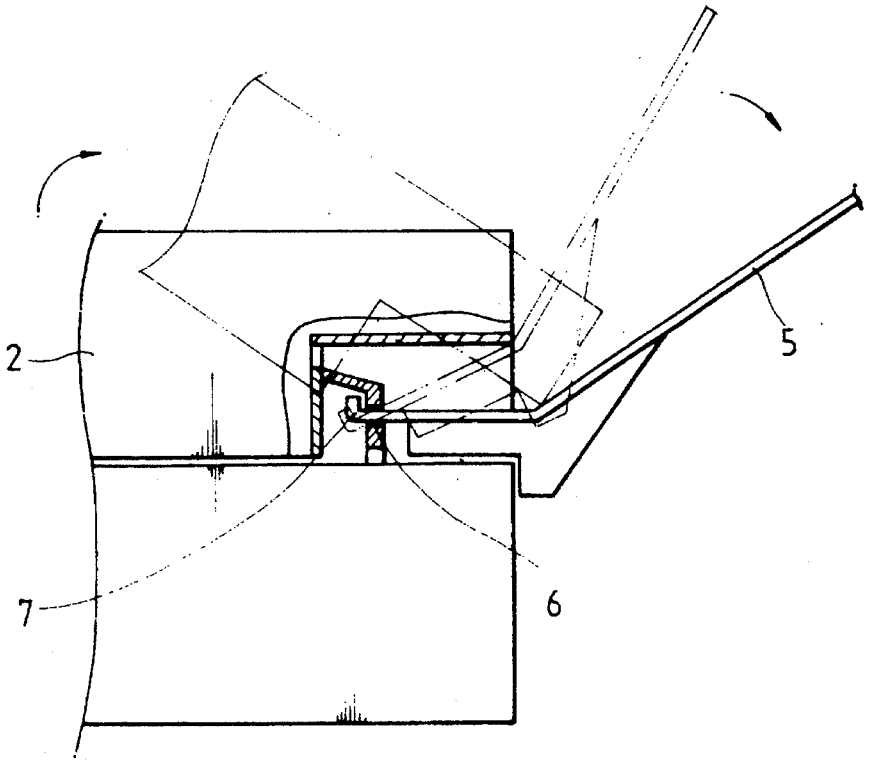
FIG. 2(PRIOR ART)
FIG. 2 is a cutaway side view of a structure of a tray of the conventional facsimile unit.
Figure 3:
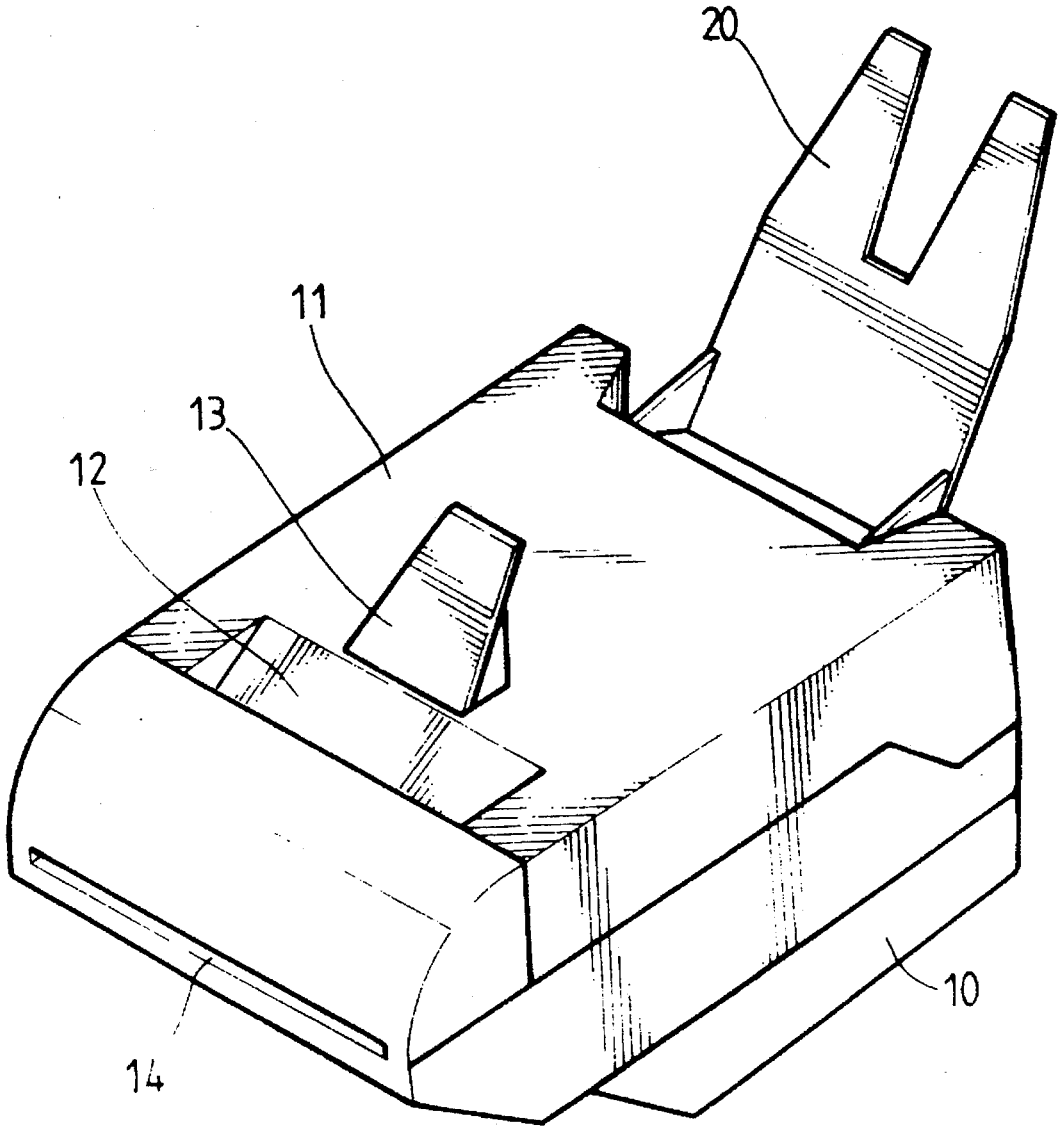
FIG. 3 is a perspective view of an image forming device constructed according to the principles of the present invention.

In a facsimile telecommunications unit so constructed, paper tray 5 is cantilevered outwardly from housing 1 so that when an operator attempts to open cover 3, as, for example, to clear a paper jam, to change a toner cartridge, or to perform routine maintenance, paper tray 5 inconveniently obstructs movement of cover 3; this is shown in FIG. 2 by a midportion of tray 5 interrupting the clockwise rotation of cover 3 (during rotation cover 3 is shown in phantom lines in FIG. 2). Also, in such a structure, the repeated opening and closing of cover 3 often results in damage to slot 6 of facsimile housing 1 or to connection 7 of paper tray 5. Therefore, to accommodate complete opening of cover 3 and to avoid damage to tray 5, slot 6 and connection 7, tray 5 should be separated from facsimile unit's housing 1 before the operator attempts to open cover 3 can be opened, an awkward requirement.

Additionally, when the facsimile unit is shipped or merely relocated within an office, the paper tray should be removed from the facsimile housing and should be either packed alongside the housing or be transported as a separate item. Therefore, handling the facsimile unit is cumbersome due to excessive shipping volume.

Turning now to FIGS. 3 through 7, an image forming device such as, by way of example, a facsimile telecommunications unit constructed according to the principles of the present invention contemplates a cover 11 forming, in one embodiment, an uppermost surface of the unit adjoining housing 10, and is hinged at the sides of the upper part of a housing 10 by means of a hinge shaft 15, so as to be capable of being opened and closed, a paper-feed inlet 12 for inserting sheets of paper bearing images or messages to be transmitted (or copied) by the unit is formed on the upper surface of cover 11, and a paper guiding board 13 for guiding these sheets is installed on the upper surface of cover 11 adjacent to paper-feed inlet 12.

Figure 5:
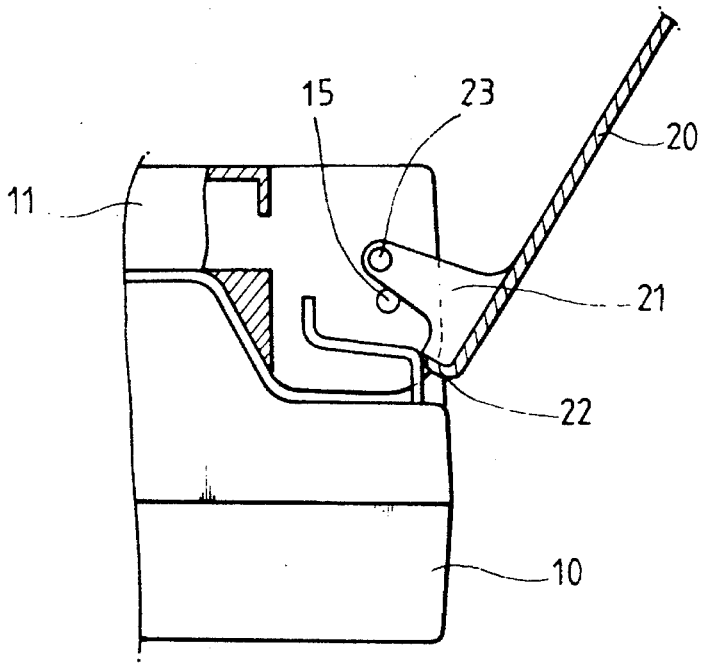
FIG. 5 is a cutaway side view of a structure of the tray of an image forming device constructed according to the principles of the present invention.

A paper outlet 14 is formed on the front surface of housing 10, to provide an exit for sheets of paper bearing messages transmitted (or copied) and discharged by the device into tray 20. Also at the sides of cover 11 and adjacent to hinge shaft 15, a self-stacking paper tray 20 for receiving, and supporting in a stack, successive sheets of papers bearing printed matter such as facsimile messages or images received, or copied, by the device is rotatably hinged by means of a hinge shaft 23 formed on the exterior of cover 11, so that the rotational path of cover 11 differs from that of tray 20. When cover 11 is closed and secured to housing 10, axis 23 is above and to the left of the axis 15 of cover 11, as is shown by FIGS. 5 and 7. As cover 11 is opened axis 23 travels along arc A shown in FIG. 6 to a position to the right of the axis 15.

Figure 4:
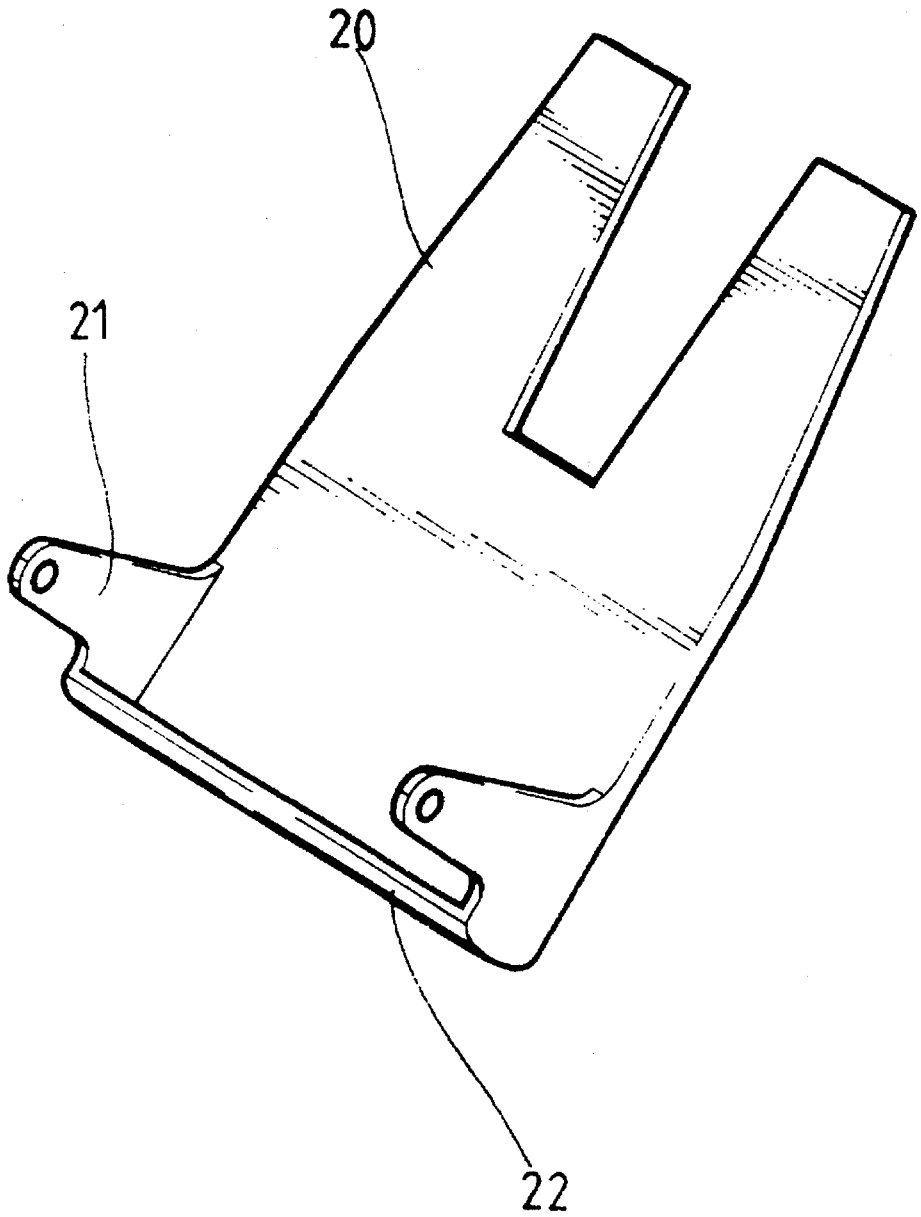
FIG. 4 is a perspective view of the tray shown in FIG. 3.

Stacking paper tray 20, as illustrated in FIGS. 4 and 5, is hinged at the sides of cover 11 so as to enable rotation by supporting-ribs 21 which extend from both sides of the tray.

At the lower part adjacent to supporting-ribs 21 of tray 20, a guiding piece 22 is formed which is in contact with housing 10 when cover 11 is rotated, ensuring that self-stacking paper tray 20 rotates together with cover 11. The external surface of guiding piece 22, that is, the surface in contact with the housing, is formed with a curved exterior surface, and with an interior surface which serves to retain in a stack, sheets of paper discharged from the unit while tray 20 is deployed with its distal end 30 positioned above its proximal end 32, with the distal end 30 extending outwardly and upwardly from the unit. The curved exterior surface of guide 22 engages an interior knee 34 of the unit while cover 11 is in its closed position, and as cover 11 is opened and axis 23 travels arc A to shift tray 20 to a more outboard and somewhat lower position relative to housing 10, guide 22 engages an exterior vertical surface of housing 10 such as, for instance, a junction 36 between a vertical bulkhead of housing 10 and an interior cavity accommodating the paper discharge port feeding tray 20. The interaction between guide 22 and such features of housing 10 as knee 34 and junction 36 assures maintenance of the desirable orientation of tray 20 with its distal end 30 remaining above proximal end 32 and outwardly disposed from housing 10 relative to proximal end 32.

Self-stacking paper tray 20, as illustrated in FIG. 7, can be folded onto cover 11 by rotating around axis 23 so that the receiving-sheet surface of tray 20 lies upon the top of cover 11.

Figure 6:
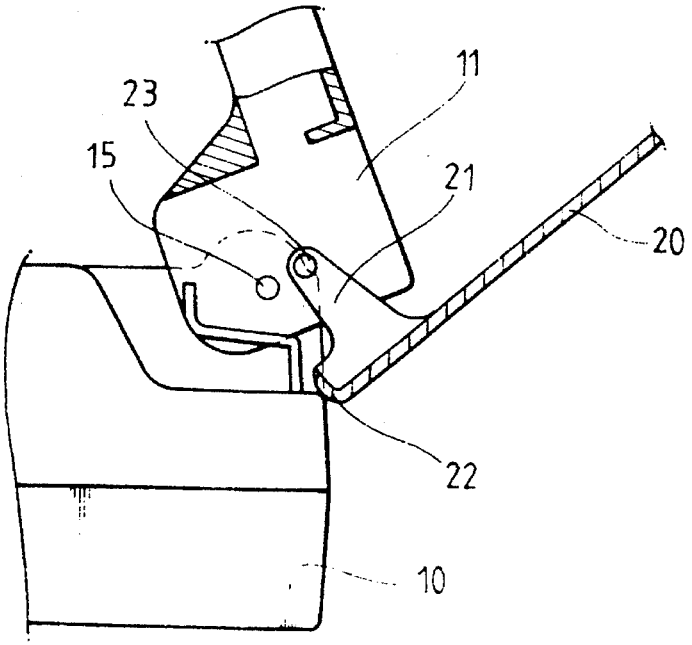
FIG. 6 is a cutaway side view showing the "open" state of the cover of the an image forming device constructed according to the principles of the present invention.
Figure 7:
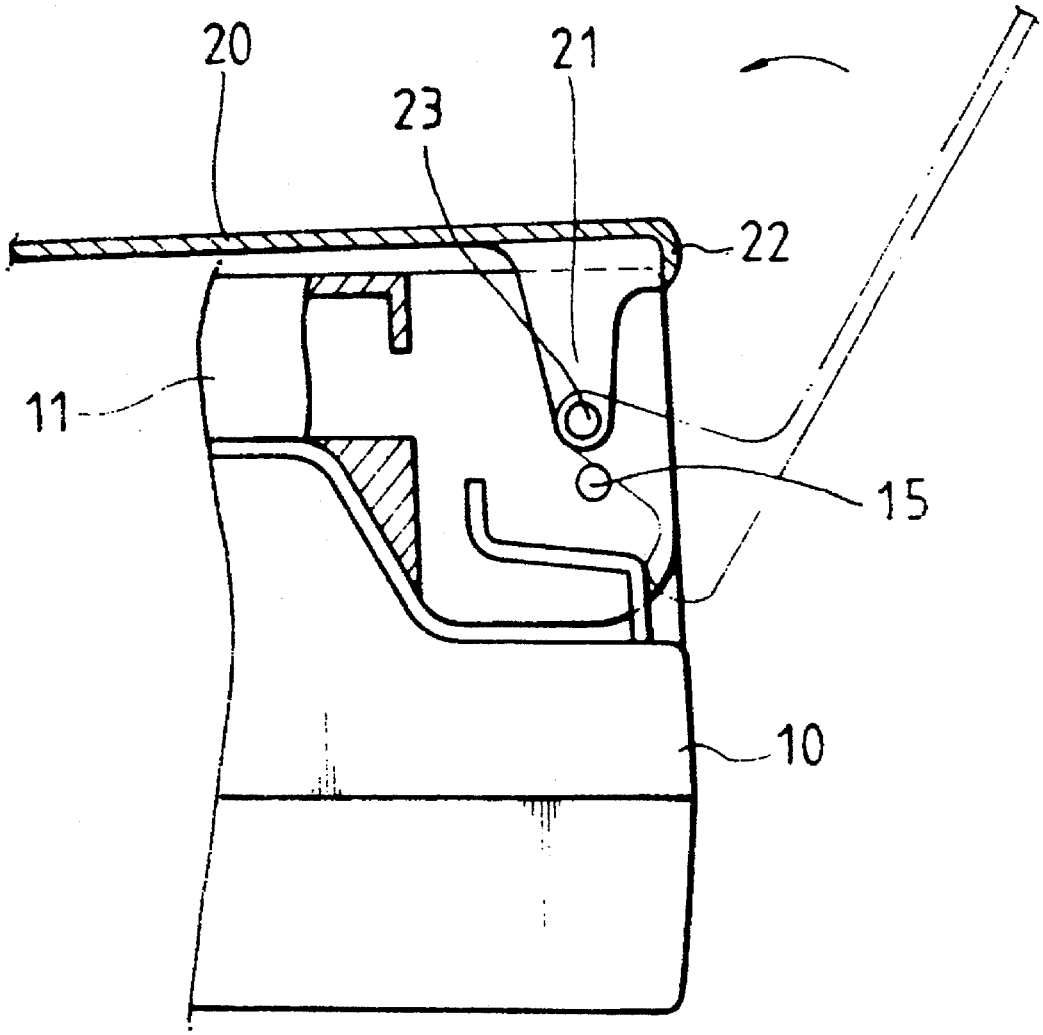
FIG. 7 is a cutaway side view showing the "folded" state of the tray of the an image forming device constructed according to the principles of the present invention.

In a facsimile unit, photocopier, printer or other image forming device constructed according to the principles of the present invention, when cover 11 is raised to be opened, as is illustrated in FIG. 6, the curved exterior surface of guiding piece 22 of tray 20, engages and makes continuous contact with the housing as the clockwise rotation of cover 11 lowers the axis 23 of supporting ribs 21 from a position above and to the left of the axis 15 of cover 11, to a position still somewhat above but now to the right of axis 15, so as to enable rotation of tray 20 together with cover 11, thereby maintaining the orientation of the distal end 30 of tray 20 above its proximal end 32 as cover 11 is opened. Accordingly, cover 11 can be completely opened without either separating or otherwise disengaging tray 20 from the image forming device, and without causing tray 20 to spill any sheets of paper stacked upon the upper surface of tray 20.

As is illustrated in FIG. 7, when the image forming device is transported (e.g., during shipping or relocation), tray 20 may be rotated around axis 23 so as to be folded onto cover 11 so that the receiving-sheet surface of cover 11 lies, in a compact configuration, flush beneath the top surface of tray 20. Therefore, in comparison with conventional facsimile units, photocopiers or printers, the volume of a packing box can be reduced by an amount approximately equivalent to the space required for the separate packing of the tray.

Besides shipping a packed image forming device, when the location of the device is moved within an office after an initial installation, the tray can be folded simply so as to enable movement of the unit without the removal of the tray. Therefore, handling is facilitated and risk of product damage can be minimized.

As described above, in the an image forming device of the present invention, the cover can be easily opened to the desired angle without first removing the external paper tray, and the tray can be folded when the image forming device is transported so that shipping volume can be reduced.

Having described a preferred embodiment of the present invention, it will be clear to those skilled in the art that modifications and alternatives to the disclosed apparatus whether in the context of a photocopier, a printer or a facsimile telecommunications unit exist within the scope and spirit of the present invention. Accordingly, it is intended to limit the scope of the present invention only as indicated in the following claims.

What is claimed is:

1. A container for an image forming device, comprising:

a housing a cover hinged at the sides of said housing so as to be capable of being opened and closed; and a tray having a distal end, a proximal end and a guiding piece, for supporting sheets of paper bearing messages received by the image forming device, said tray being hinged at said proximal end onto said cover so that a rotational path of said cover differs from that of said tray and said guiding piece being formed on said proximal end of said tray for contacting said housing to maintain an orientation of said distal end above said proximal end of said tray while said cover is opened and closed.

2. The container as claimed in claim 1, further comprised of said tray being hinged with said housing by supporting-ribs extended from a body of said tray.

3. The container as claimed in claim 1, wherein said housing further comprises:

a knee formed on said housing and extending upwardly from said housing, for contacting said guiding piece while said cover is closed; and a junction for contacting said guiding piece while said cover is open.

4. The container as claimed in claim 3, further comprised of said guiding piece being formed as a curved surface.

5. The container as claimed in claim 1, wherein said tray is installed to enable said tray to fold onto said cover by rotating said tray so that a receiving-sheet surface of said tray lies upon a top of said cover.

6. A container for an image forming device, comprising:

a housing;

a cover moveable relative to said housing between opened and closed positions;

first means defining a first axis, for rotatably joining said cover to said housing and enabling said cover to enclose components of the device contained in said housing while said cover is in said closed position relative to said housing, and enabling said cover to allow access to the components of the device while said cover is in said opened position relative to said housing;

a tray having a distal end, a proximal end and a guiding piece comprised of a curved surface formed on said proximal end of said tray, said tray being configured to receive media bearing images formed on the media by the components and discharged from said housing; and second means defining a second axis, for rotatably joining said proximal end of said tray to said cover with said guiding piece contacting said housing to maintain an orientation of said distal end above said proximal end of said tray while said cover is in said opened position and in said closed position.

7. The container of claim 6, further comprised of said first axis being spaced apart from and parallel to said second axis.

8. The container of claim 6, further comprised of:

said tray having an elongated surface positioned between said proximal end and said distal end, said elongated surface being configured to support the media discharged from the device;

said second means enabling said tray to lie in a first orientation relative to said housing with said distal end positioned above said proximal end and with said distal end spaced-apart from said housing while said tray accommodates rotation of said cover from said closed position to said opened position; and said second means enabling said tray to lie in said first orientation relative to said housing with said distal end positioned above said proximal end and with said distal end spaced-apart from said housing, while enabling said tray to receive the media from the device while said cover is in said closed position.

9. The container of claim 8, further comprised of said first axis being spaced apart from and parallel to said second axis.

10. The container of claim 8, further comprised of said tray comprising said proximal end comprising said curved surface configured:

to abut against said housing and maintain said distal end above said proximal end while said cover is in said closed position, and to abut against said housing and maintain said distal end above said proximal end while said cover is in said opened position.

11. The container of claim 6, further comprised of:

said tray having an elongated surface positioned between said proximal end and said distal end, said elongated surface being configured to support the media discharged from the device;

said second means enabling said tray to lie in a first orientation relative to said housing with said distal end positioned above said proximal end and with said distal end spaced-apart from said housing while said tray accommodates rotation of said cover from said closed position to said opened position; and said second means enabling said tray to lie in a second orientation relative to said cover with said elongated surface lying upon said cover while said cover is in said closed position.

12. The container of claim 11, further comprised of said first axis being spaced apart from and parallel to said second axis.

13. The container of claim 11, further comprised of said tray comprising said proximal end comprising said curved surface configured:

to abut against said housing and maintain said distal end above said proximal end while said cover is in said closed position, and to abut against said housing and maintain said distal end above said proximal end while said cover is in said opened position.

14. The container of claim 6, further comprised of:

said tray having an elongated surface positioned between said proximal end and said distal end, said elongated surface being configured to support the media discharged from the device;

said second means enabling said tray to lie in a first orientation relative to said housing with said distal end positioned above said proximal end and with said distal end spaced-apart from said housing while said tray accommodates rotation of said cover from said closed position to said opened position;

said second means enabling said tray to lie in said first orientation relative to said housing with said distal end positioned above said proximal end and with said distal end spaced-apart from said housing, while enabling said tray to receive the media from the device while said cover is in said closed position; and said second means enabling said tray to lie in a second orientation relative to said cover with said elongated surface lying upon said cover while said cover is in said closed position.

15. The container of claim 14, further comprised of said first axis being spaced apart from and parallel to said second axis.

16. The container of claim 14, further comprised of said tray comprising said proximal end comprising said curved surface configured:

to abut against said housing and maintain said distal end above said proximal end while said cover is in said closed position, and to abut against said housing an maintain said distal end above said proximal end while said cover is in said opened position.

17. The container of claim 6, further comprised of:

said tray having an elongated surface positioned between said proximal end and said distal end, said elongated surface being configured to support the media discharged from the device; said second means enabling said tray to lie in a first orientation relative to said housing with said distal end positioned above said proximal end and with said distal end spaced-apart from said housing while said tray accommodates rotation of said cover from said closed position to said opened position;

said second means enabling said tray to lie in said first orientation relative to said housing with said distal end positioned above said proximal end and with said distal end spaced-apart from said housing, while enabling said tray to receive the media from the device while said cover is in said closed position;

said second means enabling said tray to lie in a second orientation relative to said cover with said elongated surface lying upon said cover while said cover is in said closed position; and said second means enabling said tray to lie in said second orientation relative to said cover with said elongated surface lying upon said cover while said cover is in said opened position.

18. An image forming device, comprising:

a housing;

a cover capable of being opened and closed, for providing access into said housing;

first means defining a first axis, for rotatably joining said cover to said housing and enabling said cover to enclose components of the device contained in said housing while said cover is in a closed position relative to said housing, and enabling said cover to allow access to the components of the device while said cover is in an opened position relative to said housing;

a tray configured to receive media bearing images printed on the media by the components and discharged from said housing, said tray having a proximal end engaging said cover, a distal end, and an elongated surface positioned between said proximal end and said distal end, said elongated surface being configured to support the media discharged from the device;

second means defining a second axis, for rotatably joining said tray to said cover, said second means enabling said tray to lie in a first orientation relative to said cover with said distal end positioned above said proximal end and with said distal end spaced-apart from said housing, and enabling said tray to receive the media discharged from the housing while said cover is in said closed position; and said second means enabling said tray to lie in a second orientation relative to said cover with said elongated surface lying upon said cover while said cover is in said closed position.

19. The container of claim 18, further comprised of said tray comprising said proximal end comprising said curved surface configured:

to abut against said housing and maintain said distal end above said proximal end while said cover is in said closed position, and to abut against said housing and maintain said distal end above said proximal end while said cover is in said opened position.

20. The container of claim 19, further comprised of said first axis being spaced apart from and parallel to said second axis.

21. A container for a printing device, comprising:

a main body said main body comprising a knee portion positioned at one end of said main body and extended upwardly from said main body;

a cover pivotally attached to said main body and providing access into said main body, said cover being pivotally attached to said main body by first hinge means defining a first axis for enabling said cover to pivot upward and away from said main body while said cover is in an opened position relative to said main body to allow access to the device within said main body and enabling said cover to pivot downward and toward said main body to a closed position relative to said main body to enclose, the device contained within said main body;

a tray having a proximal end, a distal end, a guiding piece formed at said proximal end and configured to receive media discharged from the device, and an elongated surface positioned between said proximal end and said distal end and configured to support the media discharged from the device, said tray being pivotally attached to said cover by second hinge means defining a second axis for enabling said tray to maintain in a first orientation relative to said cover with said distal end positioned above and spaced-apart from said proximal end to receive the media of images discharged from the device while said cover is in one of said opened position and said closed position, and enabling said guiding piece of said tray to rest upon said knee portion of said main body when said cover is in said closed position and to slide downwardly from said knee portion into to rest upon said one end of said main body when cover is in said opened position.

22. The container as claimed in claim 21, further comprised of said second hinge means enabling said tray to lie in a second orientation relative to said cover with said elongated surface lying upon said cover while said cover is in said closed position.

23. The container as claimed in claim 21, further comprised of said proximal end comprising a curved surface configured:

to abut against said main body and maintain said distal end above said proximal end while said cover is in said closed position, and to abut against said main body and maintain said distal end above said proximal end while said cover is in said opened position.

24. The container as claimed in claim 21, further comprised of said first axis being spaced-apart from and parallel to said second axis.

25. A container for an image forming device comprising:

a housing comprising a lower body and an upper body having a major outer surface, said upper body being rotatably joined to said lower body to rotate around a first axis relative to said lower body between a closed position restricting access into an interior of said lower body and an opened position permitting access into said interior;

a tray having a distal end spaced-apart by an elongated surface from a proximal end, said proximal end being rotatably joined to said housing to receive upon said elongated surface media discharged from the device and to rotate around a second axis relative to said housing, said second axis being spaced-apart and parallel to said first axis, said second axis tracing an arc around said first axis as said upper body travels between said closed position and said opened position;

said upper body having a side wall defining an angle with and being separated by a corner from said major surface;

said proximal end comprising a guiding piece formed on said proximal end and engaging said housing while said upper body is in said closed position and while said upper body is in said opened position, with said proximal end maintaining said tray extending cantilevered outwardly from said side wall with said distal end positioned vertically higher than said proximal end while said upper body is in said closed position and while said upper body is in said opened position;

said tray accommodating displacement of said comer without touching said corner as said upper body rotates between said dosed position and said open position; and said tray being rotatable around said second axis to place said elongated surface extending along said major outer surface, with said elongated surface lying in a substantially horizontal plane while said major outer surface has a horizontal orientation.

26. The container of claim 25, comprising:

said proximal end comprising rib means extending outwardly beyond said elongated surface, for engaging said second axis and to suspend said tray from said second axis; and said guiding piece being spaced-apart by said rib means from said second axis.

* * * * *